US005299427A

United States Patent [19]

Miller et al.

[11] Patent Number: 5,299,427

[45] Date of Patent: Apr. 5, 1994

[54] ICE TRANSPORT AND DISPENSING SYSTEM

[75] Inventors: Benjamin D. Miller, Des Plaines; Thaddeus M. Jablonski, Palatine; Peter S. Tinucci, Elmhurst, all of Ill.

[73] Assignee: Remcor Products Company, Glendale Hts, Ill.

[21] Appl. No.: 29,293

[22] Filed: Mar. 8, 1993

Related U.S. Application Data

[63] Continuation of Ser. No. 887,170, May 21, 1992, abandoned.

[51] Int. Cl.[5] ..... F25C 5/18

[52] U.S. Cl. ..... 62/66; 62/137; 62/344; 222/146.6; 414/287

[58] Field of Search ..... 62/66, 137, 344; 222/146.6, 185; 414/287

[56] References Cited

U.S. PATENT DOCUMENTS

| | | | |
|---|---|---|---|
| 3,246,218 | 4/1966 | Lorenz | 62/137 X |
| 3,277,666 | 10/1966 | Simmons | 62/344 X |
| 3,305,138 | 2/1967 | Plumb | 222/185 X |
| 3,877,241 | 4/1975 | Wade | 62/344 X |
| 4,104,889 | 8/1978 | Hoenisch | 62/344 X |
| 4,276,750 | 7/1981 | Kawasumi | 62/137 |
| 4,300,359 | 11/1981 | Koeneman et al. | 62/344 X |
| 4,771,609 | 9/1988 | Funabashi | 62/344 X |
| 5,020,336 | 6/1991 | Hida | 62/344 |
| 5,165,255 | 11/1992 | Alvarez et al. | 62/344 |

*Primary Examiner*—William E. Tapolcai
*Attorney, Agent, or Firm*—Juettner Pyle & Lloyd

[57] ABSTRACT

An ice transport and dispensing system includes an ice maker for introducing ice into a remote ice storage bin and a plurality of ice dispensing stations that receive ice from the bin. Each dispensing station has an ice storage hopper, and at least one downwardly sloping ice delivery conduit extends between the bin and the hoppers for a flow of ice through the conduit from the bin to the dispensing stations solely under the influence of gravity. So that a single conduit can deliver ice to at least two dispensing stations, the conduit extends past one of the stations and leads to the other station and an ice diverter assembly is actuable to divert a flow of ice from the conduit to the one station. A control circuit monitors the level of ice in the hoppers of the dispensing stations and operates the system in a manner to maintain a supply of ice in each hopper.

23 Claims, 2 Drawing Sheets

ROOF
FALSE CEILING
ICE MAKER
30
32
REMOTE ICE STORAGE BIN
22
T1
T2
G1
G2
24
26
28
E
CONTROL CIRCUIT
34
T1
T2
T3
T4
T5
ICE
E
G1
G2
D
ICE DISPENSER STATION
36
38
40
42
44
46
T3
T4
T5
G3
G4
G5
20
D
52
54
56
58
60
62
64
48
50

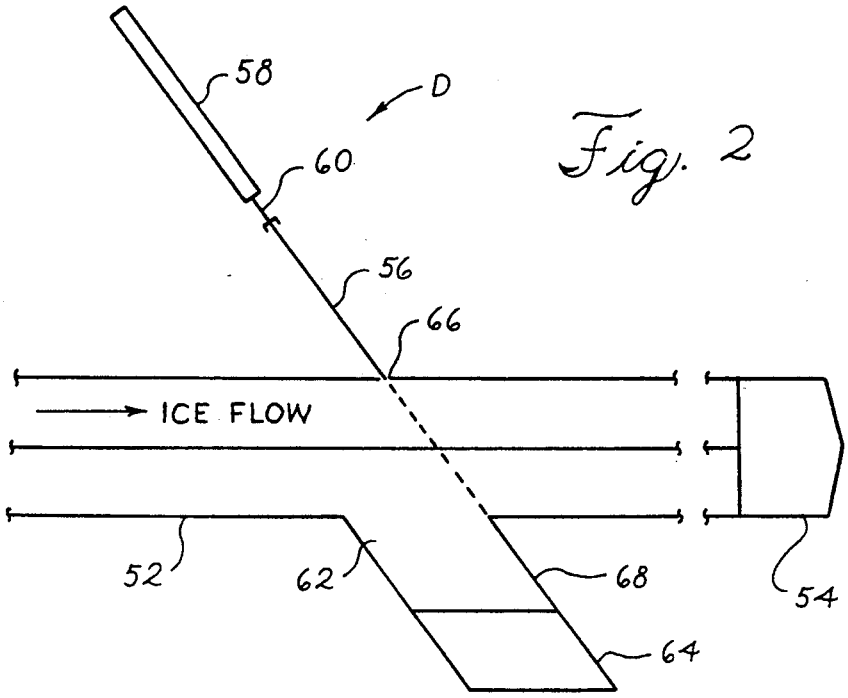
Fig. 2
Fig. 3
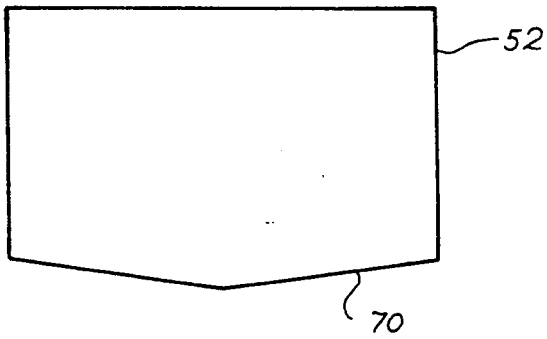
| T2 | T3 | T4 | T5 | G1 | G2 | D | E |
|---|---|---|---|---|---|---|---|
| 1 | 0 | 0 | 0 | 0 | 0 | 0 | 0 |
| 1 | 1 | 1 | 1 | 0 | 0 | 0 | 0 |
| 0 | 0 | 0 | 1 | 0 | 1 | 0 | 1 |
| 0 | 0 | 1 | 1 | 0 | 1 | 1 | 1 |
| 0 | 1 | 0 | 1 | 1 | 1 | 0 | 1 |
| 0 | 1 | 1 | 1 | 1 | 1 | 1 | 1 |
| 0 | 0 | 1 | 0 | 0 | 1 | 1 | 1 |
| 0 | 1 | 1 | 0 | 1 | 1 | 1 | 1 |
| 0 | 1 | 0 | 0 | 1 | 0 | 0 | 1 |
| 0 | 0 | 0 | 0 | 0 | 0 | 0 | 0 |
| 0 | 1 | 1 | 1 | 1 | 1 | 1 | 1 |
0 = ICE | 0 = DEENERGIZED
1 = NO ICE | 1 = ENERGIZED
Fig. 4

ICE TRANSPORT AND DISPENSING SYSTEM

This is a continuation of copending application Ser. No. 07/887,170 filed on May 21, 1992, now abandoned.

BACKGROUND OF THE INVENTION

The present invention relates to ice dispensing, and in particular to an ice transport and dispensing system that has a plurality of ice dispensing stations and a remote source of ice from which ice is delivered to the dispensing stations.

It is known to convey ice from a remote ice storage bin to one or more ice dispensing stations, for example as taught by U.S. Pat. No. 4,104,889. In such systems, a conduit extends between and communicates the remote storage bin and the ice dispensing stations and a relatively high velocity flow of air is generated through the conduit to cause ice particles introduced into the conduit from the storage bin to be transferred through the conduit to the dispensing stations. Such systems are useful in an installation where an ice maker or other ice source must be at a remote location, since the system functions to convey ice from the remote location to stations where the ice particles may be stored and/or dispensed. A single conduit extending from the remote ice source may deliver ice to a plurality of dispensing stations by using diverter valves to direct the ice out of the conduit to selected ones of the stations.

Although ice transport systems that utilize air as an ice conveying fluid are capable of delivering ice from a storage bin to dispensing stations located at substantial distances from the bin, they disadvantageously require an air blower, which adds expense, complexity and noise to the system. Also, for proper conveyance of ice, the flow of air must be relatively unimpeded, which can require the relatively noisy expedient of venting air from the system. Further, the relatively high velocity flow of air causes the ice particles to be conveyed through the system as a relatively high velocity, resulting in damage to the ice particles as they impinge at high speed against system parts.

OBJECTS OF THE INVENTION

An object of the present invention is to provide an ice transport and dispensing system that utilizes gravity to convey ice through a conduit from a remote ice storage bin to a plurality of ice dispensing stations.

Another object is to provide such a system that utilizes a diverter valve for selectively diverting an ice flow from the conduit into a dispensing station that is to receive ice.

A further object is to provide such a system in which a lower surface of the conduit is V-shaped to provide for straight tracking of ice particles through the conduit.

Yet another object is to provide such a system in which the conduit progressively increases in cross sectional area with increasing distances from the ice storage bin to prevent ice jams within the conduit.

SUMMARY OF THE INVENTION

In accordance with the present invention, an ice transport and dispensing system comprises a source of particles of ice; at least two ice dispensing stations located vertically beneath the ice source; and downwardly sloping conduit means extending from the ice source to each of the at least two ice dispensing stations and defining an ice flow path for delivery of ice from the ice source to the dispensing stations. Also included is an ice diverting apparatus, along with means for introducing particles of ice from the ice source into the downwardly sloping conduit means for sliding flow of the ice particles along the conduit means solely under the influence of gravity. In addition, there is an ice level sensing means at each of the ice dispensing stations for sensing the quantity of ice at the stations and for providing a control signal to the ice diverting apparatus in accordance with the sensed quantities of ice. The ice diverting apparatus is actuable in a first mode to cause ice particles flowing along the conduit means to bypass one of the ice dispensing stations and flow to the other ice dispensing station, and is actuable in a second mode in response to the control signal to cause ice particles flowing along the conduit means to be diverted to the one dispensing station.

The invention also contemplates a method of transporting ice from a source of ice particles to at least two remote ice dispensing stations. The method comprises the steps of providing a downwardly sloping ice flow path extending from the ice source to each of the at least two remote ice dispensing stations; sliding ice particles from the ice source along the ice flow path solely under the influence of gravity; and sensing the quantity of ice particles at each of the remote ice dispensing stations. In addition, included are the steps of generating a control signal having a value in accordance with the sensed quantities of ice at the ice dispensing stations; in response to one value of the control signal, causing ice particles sliding along the flow path to bypass one of the ice dispensing stations and to slide along the flow path to the other of the ice dispensing stations; and in response to another value of the control signal, causing ice particles sliding along the flow path to be diverted to the one ice dispensing station.

The foregoing and other objects, advantages and features of the invention will become apparent upon a consideration of the following detailed description, when taken in conjunction with the accompanying drawings.

BRIEF DESCRIPTION OF THE DRAWINGS

FIG. 2 is a top plan view of a portion of an ice conveying conduit and an associated diverter gate for diverting a flow of ice from the conduit and into an ice dispensing station;

FIG. 3 illustrates the cross sectional configuration of the ice conveying conduit, and FIG. 4 is a truth table showing the manner of operation of the system.

DETAILED DESCRIPTION

Figure 1:
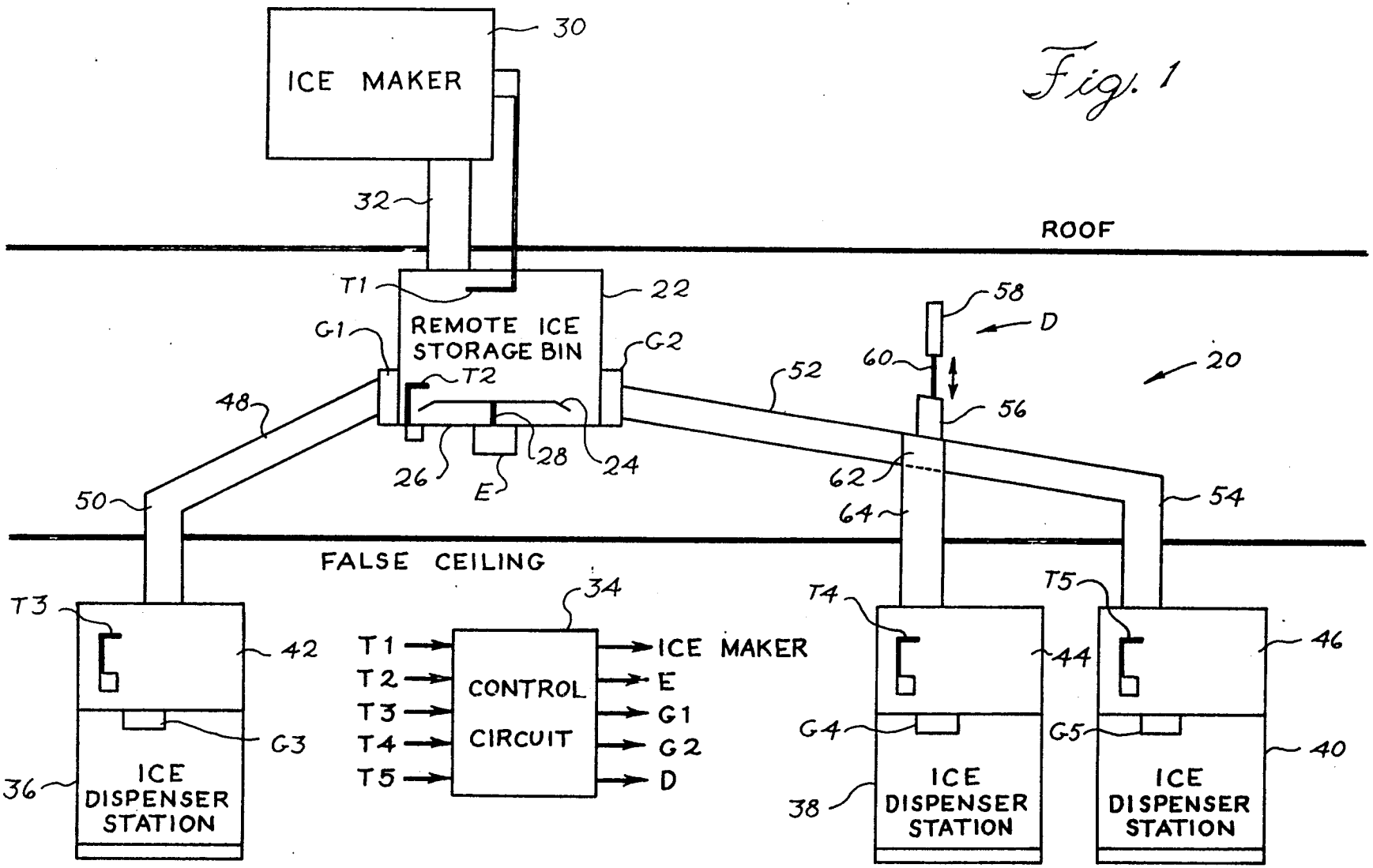
FIG. 1 is block diagram of an ice transport and dispensing system that embodies the teachings of the present invention.

There is shown in FIG. 1, and indicated generally at 20, an embodiment of ice transport and dispensing system that incorporates the teachings of the present invention. The system includes a remote ice storage bin 22 for storing a large quantity of ice particles, such as ice cubes. Within the ice storage bin is a rotary impeller or agitator 24 that is driven by an electric motor E. For the embodiment of system shown, the storage bin has two gate means G1 and G2 which accommodate discharge of ice from the bin through lower bin openings (not shown). The gate means are conventional and may take the form of any of the dispensing gates disclosed in U.S. Pat. Nos. 3,165,901, 3,211,338 and 3,217,509, to which reference is made for a more detailed description. In essence, each gate means includes a gate that is selectively movable between positions uncovering and covering its associated bin opening to establish and interrupt a path for flow of ice bodies from the bin through the opening and gate means.

The ice storage bin 22 is essentially a tub that may be of circular or other cross section, but preferably is of polygonal cross section, as disclosed in U.S. Pat. No. 3,517,860, to facilitate maintaining the ice bodies in discrete, free-flowing form. Although not specifically shown, the bottom of the bin may advantageously be provided with a circular depression or annular trough, such that the openings to the gate means G1 and G2 are spaced a short distance above the bottom of the trough, and the trough may be provided at its bottom with melt water drain holes, so that only discrete particles of relatively dry ice pass through the gate means.

A bottom wall 26 of the ice storage bin 22 is centrally apertured for upward, liquid sealed passage of a shaft 28 of the agitator drive motor E, the motor being mounted on the bottom wall exteriorally of the bin. Carried on the shaft within the interior of the bin is the agitator 24 which has a plurality of radial arms that engage the mass of ice particles in the bin to cause the mass to rotate. The agitator motor may comprise an electric gear motor and is operated when either or both gate means G1 and G2 are energized and opened to facilitate movement of ice bodies through the gate means.

To maintain a supply of ice in the storage bin 22 and to replenish ice removed therefrom, an ice maker 30 has an ice outlet drop chute 32 leading into the upper end of the bin. To control operation of the ice maker 30 in order to maintain ice in the bin at a selected level, a thermostat T1 is in the bin at the level at which ice is to be maintained. The thermostat, which senses the presence or absence of ice therearound, is connected as an input to a control circuit 34. The control circuit operates the ice maker, in response to signals from the thermostat T1, in a manner to maintain ice in the bin at the level of the thermostat. The control circuit may operate the ice maker according to any conventional control scheme, for example as is described in U.S. Pat. No. 4,227,377. Also within the bin is a thermostat T2, which is at a low level and senses when the bin is almost empty of ice bodies.

The ice transport and dispensing system 20 has a plurality of ice dispensing stations that receive ice from the remote ice storage bin 22, which in the illustrated embodiment comprises three ice dispensing stations 36, 38 and 40. Each dispensing station 36, 38 and 40 includes an associated ice storage hopper 42, 44 and 46. Each ice dispensing station also has an associated ice dispensing gate G3, G4 and G5 for dispensing ice from the hopper of the station. Although not shown, associated with each hopper would be an agitator within the hopper and an electric motor for rotating the agitator to facilitate movement of ice bodies through the dispensing gate of the station. The hopper, agitator, agitator motor and dispensing gate of each dispensing station may be similar to or the same as the bin 22, agitator 24, agitator motor E and dispensing gate G1, although the hoppers would normally be of a smaller size than the bin. Within each hopper 42, 44 and 46 is an associated thermostat T3, T4 and T5 for sensing whether ice in the hopper is at a desired level. The thermostats T2, T3, T4 and T5 are connected as inputs to the control circuit 34.

The hoppers of the ice dispensing stations are supplied with ice from the remote ice storage bin 22. To deliver ice from the bin to the hopper 42 of the ice dispensing station 36, a delivery conduit 48 connects at one end to the bin gate means G1 and extends outwardly and slopes downwardly from the gate means to a generally vertically disposed drop chute 50 that leads to the upper end of the hopper. Upon energizing the gate means G1 and the agitator motor E, ice bodies from the bin flow through the gate means and into the delivery conduit 48 and are conveyed solely under the influence of gravity through the downwardly sloping conduit to the drop chute 50 and into the hopper. Ice continues to be delivered from the bin to the hopper for as long as the gate means G1 is energized.

To deliver ice from the bin 22 to each of the hoppers 44 and 46 of the ice dispensing stations 38 and 40, a delivery conduit 52 extends outwardly and slopes downwardly from the gate means G2 to a drop chute 54 that leads to the upper end of the hopper 46. A diverter gate assembly, indicated generally at D, is intermediate the gate means G2 and the drop chute and comprises a gate 56 and a pneumatic cylinder 58 having a piston rod 60 connected to the gate for moving the gate into and out of the delivery conduit through a slot (not shown) in an upper surface of the conduit. The gate is generally planar and is angled relative to the direction of travel of ice bodies through the delivery conduit. When the gate is extended into the conduit and into the path of ice bodies flowing through the conduit, it diverts the ice bodies through an opening 62 in the side of the conduit and into a drop chute 64 that leads to the upper end of the hopper 44 of the ice dispensing station 38. The arrangement is therefore such that when the diverter gate means D is energized and the gate 56 is extended into the delivery conduit, ice particles exiting the gate means G2 and flowing through the delivery conduit solely under the influence of gravity, are deflected through the opening 62 and into the drop chute 64 for introduction into the hopper 44. When the diverter gate means is not energized and the gate is withdrawn from the delivery conduit, ice particles flowing through the conduit bypass the opening 62 and flow to the drop chute 54 for introduction into the hopper 46.

FIG. 2 shows the delivery conduit 52 at the diverter gate assembly D and a contemplated arrangement of the diverter gate assembly to one side of the conduit. The gate 56 is adapted to be moved by the pneumatic cylinder 58 into and out of the delivery conduit through a slot 66 in the one side of the conduit. Ice flows or slides through the downwardly sloping conduit in the direction shown by the arrow, and the gate is angled with respect to the direction of the flow of ice, such that when the gate is extended into the conduit, ice striking the gate is deflected through the opening 62 in the side of the conduit. Upon passing through the opening, the ice enters an upper portion 68 of the drop chute 64 for flow into the hopper 44 of the ice dispensing station 38.

It is desirable that ice particles track straight through the delivery conduit 52, generally along the center of the bottom of the conduit, so that when the diverter gate assembly D is deenergized and open for a flow of ice to the hopper 46, ice particles will flow cleanly past and not enter the opening 62. As best seen in FIG. 3, this is accomplished by providing the delivery conduit with a V-shaped bottom wall 70. The "V" runs along the center of the bottom wall, and the two halves of the bottom wall to opposite sides of the "V" define an included angle on the order of about 175°. Ice pieces flowing along the bottom wall under the influence of gravity are therefore urged toward the center of the bottom wall and flow cleanly past the opening 62 when the diverter gate means D is deenergized and open. This is important, since to facilitate movement of ice pieces through the opening when the diverter gate assembly is energized and closed, the bottom edge of the opening is coincident with an outer edge of the bottom wall 70, so that there is no lip for ice pieces to pass over in moving through the opening. Consequently, ice pieces can readily pass through the opening, but because the V-shape of the delivery conduit bottom wall keeps the ice pieces toward the center of the bottom wall, they cleanly bypass the opening when the diverter gate is open.

The delivery conduit 52, or at least its bottom wall 70, is advantageously made of a low friction material to facilitate movement of ice pieces through the conduit under the influence of gravity. To establish and reliably maintain such sliding movement of ice pieces through the delivery conduits 48 and 52, it is contemplated that their minimum downward slope be on the order of at least 15°, and preferably at least 20°. Also, to preclude or at least inhibit occurrence of ice jams, the delivery conduits advantageously progressively increase in cross sectional area with increasing distances from the remote ice storage bin 22.

The dispenser gates G3, G4 and G5 of the ice dispenser stations 36, 38 and 40 are manually operated whenever it is desired to dispense a quantity of ice. Otherwise, the system is automatically operated by the control circuit 34 in response to and in accordance with inputs from the ice level sensing thermostats T1, T2, T3, T4 and T5. The thermostat T1 senses whether the remote storage bin 22 is filled with ice and controls operation of the ice maker 30, such that when the level of ice in the bin falls below the level of the thermostat, the ice maker is turned on to introduce ice into the bin.

The thermostat T2 senses when the remote ice storage bin 22 has been emptied of ice, and the thermostats T3, T4 and T5 sense the level of ice in the hoppers 42, 44 and 46. These thermostats are connected as inputs to the control circuit 34, and with reference to the truth table of FIG. 4, it is seen that when the remote ice storage bin is empty as sensed by the thermostat T2, then irrespective of any demand for ice at the hoppers 42, 44 and 46, as indicated to the control circuit by one or more of the thermostats T3, T4 and T5 sensing less than a full hopper, the remote ice bin dispensing gates G1 and G2 are maintained deenergized and closed, until such time as the bin thermostat T2 again senses ice and signals the control circuit that the storage bin no longer is empty.

When there is ice in the remote storage bin 22, as sensed by the thermostat T2, and for as long as the thermostat T2 senses the presence of ice, the ice transport and dispensing system operates in response to demands for ice by the ice dispenser station thermostats T3, T4 and T5. When the thermostat T3 senses that the hopper 42 of the ice dispensing station 36 is less than full, the bin agitator motor E and dispensing gate G1 are energized to flow ice through the delivery conduit 48 and drop chute 50 into the hopper 42. Upon the thermostat T4 sensing that the hopper 44 of the ice dispenser station 38 requires filling, the storage bin agitator motor E and dispensing gate G2, along with the diverter gate assembly D, are energized to deliver ice from the bin into the hopper 44. For the embodiment of ice transport and dispensing system shown, filling of the hopper 44 takes priority over filling of the hopper 46, so if both the thermostats T4 and T5 signal a demand for ice, only the hopper 44 will receive ice. However, should the thermostat T5 sense that the hopper 46 requires filling with ice while the thermostat T4 is sensing that the hopper 44 is filled, then the bin agitator motor E and dispenser gate G2 will be energized, but not the diverter gate assembly D, for a flow of ice from the bin into the hopper 46.

The ice transport and dispensing system 20 is therefore adapted for use where a single ice maker is to manufacture ice for a plurality of remote ice dispensing stations, which remote ice dispensing stations do not have their own ice makers. The remote ice storage bin 22 serves as a reservoir for ice particles, such as ice cubes, so that the system can promptly meet demands for ice by the remote ice dispensing stations. Since the system relies upon gravity delivery of ice to the dispensing stations, the remote ice storage bin must be located vertically above the dispensing stations. Although the ice maker 30 need not be vertically above the storage bin 22, since a mechanical ice transport means could be utilized to convey ice from the ice maker to the bin, it may be most convenient to mount the ice maker above the bin for gravity delivery of ice from the ice maker to the bin. For the system shown in FIG. 1, the ice maker is mounted on the roof of a building, the ice dispensing stations are located in a room or rooms of the building, and the remote ice storage bin is between the roof and a false ceiling.

Although the ice transport and dispensing system as illustrated and described has an ice storage bin with two dispensing gates and three ice dispensing stations, the invention contemplates the use of fewer or more dispensing gates and fewer or more ice dispensing stations. For example, the system could have only the dispensing gate G2 and the ice dispensing stations 44 and 46. Also, instead of having just one ice dispensing station 44 that receives ice via a diverter gate means D, additional ice dispensing stations and associated diverter gate means could be provided. In addition, the ice storage bin could have three or more dispensing gates that couple to additional ice dispensing stations. It is understood, of course, that for other embodiments of ice transport and dispensing systems, the control circuit 34 would be provided with an appropriate mode of operation to accommodate maintaining the hoppers of the various ice dispenser stations full of ice according to a desired scheme.

While one embodiment of the invention has been described in detail, various modifications and other embodiments thereof may be devised by one skilled in the art without departing from the spirit and scope of the invention, as defined in the appended claims.

What is claimed is:

1. An ice transport and dispensing system, comprising:

a source of particles of ice;

at least two remote ice stations located below said source of ice, each said ice station having a hopper for storing a mass of particles of ice;

downwardly sloping path means extending from said ice source to each of said at least two ice stations and defining a path for delivery of ice from said ice source to said ice stations;

an ice diverting apparatus;

means for introducing particles of ice from said source onto said downwardly sloping path means for movement of the ice particles along said path means solely under the influence of gravity; and ice level sensing means at each of said ice stations for sensing the quantity of ice in said hoppers of said stations and for providing a control signal to said ice diverting apparatus, said ice diverting apparatus being actuable in a first mode to cause ice particles moving along said path means to bypass one of said ice stations and to flow to said hopper of the other of said ice stations, said ice diverting apparatus being actuable in a second mode in response to said control signal to cause ice particles moving along said path means to be diverted into said hopper of said one ice station.

2. An ice transport and dispensing system as in claim 1, wherein said ice source comprises a bin for holding a mass of particles of ice, and said means for introducing comprises ice dispensing gate means and means for operating said ice dispensing gate means to communicate the interior of said bin with said path means for introduction of ice particles from said bin onto said path means.

3. An ice transport and dispensing system as in claim 1, wherein said path means has a downward slope of at least 15°.

4. An ice transport and dispensing system as in claim 1, wherein said ice diverting apparatus includes a gate that is extendable generally across said path means, said ice diverting apparatus being actuable in response to said control signal to extend said gate generally across said path means and into the path of ice particles moving along said path means to divert the ice particles into said hopper of said one ice station.

5. An ice transport and dispensing system as in claim 1, wherein said path means comprises conduit means having an opening in communication with said hopper of said one ice station and said ice diverting apparatus is actuable in response to said control signal to divert ice particles moving through said conduit through said opening and into said hopper of said one ice station.

6. An ice transport and dispensing system as in claim 5, wherein said ice diverting apparatus includes a gate extendable into said conduit means and into the path of ice particles moving therethrough to divert the ice particles through said opening and into said hopper of said one ice station.

7. An ice transport and dispensing system as in claim 6, wherein said opening is in a side wall of said conduit means and said gate is generally planar and extendable into said conduit in a plane that forms an obtuse included angle with the direction of movement of ice particles through said conduit means.

8. An ice transport and dispensing system as in claim 6, wherein said gate is extendable into said conduit means through a slot in a side wall of said circuit means.

9. An ice transport and dispensing system as in claim 6, wherein said gate is extendable into said conduit means through a slot in a top wall of said conduit means.

10. An ice transport and dispensing system as in claim 6, including a pneumatic cylinder for extending said gate into said conduit means.

11. An ice transport and dispensing system as in claim 5, wherein said opening is in a side wall of said conduit means and said conduit means has a bottom wall that is V-shaped in cross section to guide ice particles past said opening when said ice diverting apparatus is not actuated to divert ice particles into said hopper of said one ice station.

12. An ice transport and dispensing system as in claim 11, wherein said conduit means bottom wall is generally planar to opposite sides of the "V" and said opening has a bottom edge that is coincident with a side edge of said conduit means bottom wall.

13. A method of transporting ice from a source of ice particles to at least two remote ice stations, comprising the steps of:

providing a downwardly sloping ice path extending from the ice source to each of the at lest two remote ice stations;

moving ice particles from the ice source along the ice path solely under the influence of gravity;

sensing the quantity of ice particles at each of the remote ice stations;

generating a control signal having a value in accordance with the sensed quantities of ice at the ice stations;

in response to one value of the control signal, causing ice particles moving along the path to bypass one of the ice stations and to move along the path to the other of the ice stations; and in response to another value of the control signal, causing ice particles moving along the path to be diverted to the one ice station.

14. A method as in claim 13, wherein said step of providing a downwardly sloping ice path provides an ice path having a downward slope of at least 15°.

15. A method as in claim 13, wherein said step of causing ice particles to be diverted comprises extending a gate across the ice path to divert ice particles sliding along the path into the one ice station.

16. A method as in claim 13, wherein said step of providing an ice path provides a downwardly sloping conduit that extends from the ice source to the at least two remote ice stations and that has an opening in communication with the at least one ice station, and said step of causing ice particles to be diverted causes the ice particles to be diverted through the conduit opening to the one ice station.

17. A method as in claim 16, wherein said step of causing the ice particles to be diverted causes a gate to be extended into the conduit into the path of the ice particles moving therethrough to divert the ice particles through the conduit opening to the one ice station.

18. A method as in claim 16, wherein the opening is in a side wall of the conduit, and including the step of providing a bottom wall for the conduit that is V-shaped in cross section to guide moving ice particles past the opening when ice particles are to be delivered to the other ice station.

19. An ice transport and dispensing system, comprising:

a source of particles of ice;

at least two remote ice stations located below said source of ice, each said ice station having a hopper for storing a mass of particles of ice;

at least two downwardly sloping path means, each extending from said ice source to an associated one of said at least two ice stations and each defining an ice path for delivery of ice from said ice source to its associated ice station;

at least two ice dispensing means, each for introducing particles of ice from said source onto an associated one of said downwardly sloping path means for movement of the ice particles along its associated path means, solely under the influence of gravity, to an associated ice station; and ice level sensing means at each of said ice stations, each for sensing the quantity of ice in said hopper of its associated station and for providing a control signal in response to a selected change in the quantity of ice to cause its associated ice dispensing means to introduce ice onto its associated path means.

20. An ice transport and dispensing system as in claim 19, wherein said ice source comprises a bin for holding a mass of particles of ice, and said at least two ice dispensing means each comprise ice dispensing gate means and means for operating each said ice dispensing gate means to communicate the interior of said bin with the path means associated with the ice dispensing gate means for introduction of ice particles from said bin onto the associated path means.

21. An ice transport and dispensing system as in claim 19, wherein each said path means has a downward slope of at least 15°.

22. A method of transporting ice from a source of ice particles to at least two remote ice stations, each ice station having a hopper for storing a mass of particles of ice, comprising the steps of:

providing at least two downwardly sloping ice paths, each extending from the ice source to the hopper of an associated one of the ice stations;

sensing the quantity of ice particles in the hopper of each of the ice stations; and in response to a selected decrease in the quantity of ice in the hopper of an ice station, causing ice particles from the ice source to be introduced onto the ice path associated with such ice station for movement of the ice particles along the ice path, solely under the influence of gravity, to the hopper of the ice station.

23. A method as in claim 13, wherein said step of providing at least two downwardly sloping ice paths provides ice paths having a downward slope of at least 15°.

* * * * *